US005390471A

United States Patent [19]

Marchadour

[11] Patent Number: 5,390,471

[45] Date of Patent: Feb. 21, 1995

[54] FOOD CAN CRIMPING HEAD INCLUDING MEANS FOR TAKING UP SLACK

[75] Inventor: Jean-Charles Marchadour, Saint Jean Trolimon, France

[73] Assignee: Hema Technologies, Quimper, France

[21] Appl. No.: 79,157

[22] Filed: Jun. 17, 1993

[30] Foreign Application Priority Data

Jun. 22, 1992 [FR] France ..... 92 07594

[51] Int. Cl.[6] ..... B65B 7/28

[52] U.S. Cl. ..... 53/334; 413/33

[58] Field of Search ..... 53/334, 335, 336, 337, 53/338, 339, 340; 413/6, 32, 33

[56] References Cited

U.S. PATENT DOCUMENTS

| | | | |
|---|---|---|---|
| 1,972,866 | 9/1934 | Butler | 413/33 |
| 2,149,543 | 3/1939 | Peyser et al. | 413/33 |
| 2,271,152 | 1/1942 | Kronquest | 413/32 |
| 2,432,815 | 12/1947 | Schmitt | 413/32 |
| 2,467,154 | 4/1949 | Peterson, Jr. | 413/32 |
| 2,907,293 | 10/1959 | Peterson, Jr. | 413/32 |

*Primary Examiner*—Horace M. Culver
*Attorney, Agent, or Firm*—Michael, Best & Friedrich

[57] ABSTRACT

The invention relates to a crimping head that comprises at least one crimping roller for crimping the lid of a food can. The roller is guided along a path that surrounds the can by means of a support piece that includes a hub rotatable about the axis of the crimp head, together with a head carrying a stub axle on which both a cylindrical wheel running on a cam surface and a bulging wheel running on a counter-cam surface are mounted about a common axis, the counter-cam surface being inclined at a small angle. The position of the stub axle together with the wheels is adjustable along the axis so as to take up any slack in guidance.

7 Claims, 2 Drawing Sheets

FOOD CAN CRIMPING HEAD INCLUDING MEANS FOR TAKING UP SLACK

FIELD OF THE INVENTION

The present invention relates to a crimping head for scaling food cans by crimping a lid on a can body, the head comprising at least one crimping roller mounted on a moving support piece that causes the head to move in a plane parallel to a work plane on which the can to be crimped stands, so as to follow a path such that it follows exactly the outline of the can while remaining pressed thereagainst so as to crimp the edge of the lid onto the edge of the can body, guide means associated with said support piece constraining said roller to follow said path, which guide means comprise a rotary wheel whose axis is perpendicular to said work plane and which is linked to said support piece, and a cylindrical camming surface whose generator lines are likewise perpendicular to the work plane and follow an appropriate outline that extends parallel to the work plane, said wheel running against the cam surface under the action of holding means that hold it in contact therewith.

BACKGROUND OF THE INVENTION

In crimping heads of this kind, used in particular for crimping food cans of non-circular outline ("shaped cans"), the guide wheel associated with each crimping roller is held in contact with the cam surface by a spring. Although operation with return springs is satisfactory so long as the crimping head is working at a low rate, the same is not true when the rate is significantly increased. Inertia effects then become important and cause the guide wheels to lift off undesirably. In addition, since the springs are subjected to violent forces at a high frequency, they need to be replaced periodically.

OBJECT AND SUMMARY OF THE INVENTION

An object of the present invention is to remedy those drawbacks. To this end, according to the invention, the above-mentioned return springs for each wheel are replaced by holding means holding said wheel in contact with the cam surface and comprising firstly a second rotary wheel juxtaposed with the first wheel and rotating about the same axis, the second wheel having a bulging peripheral surface whose section in a radial plane is a curved line with its convex side on the outside, and secondly, situated facing the above-mentioned cam surface, a counter-cam surface constituting a bearing and running surface for the second wheel and extending parallel to the cam surface while being inclined at a small angle relative to the direction of the common axis of the two wheels, and the relative position along the direction of said axis between the second wheel and the counter-cam surface is adjustable so as to make it possible to adjust the slack between the assembly of the two wheels and the facing cam and counter-cam surfaces between which said assembly is interposed.

Such a disposition ensures that the first wheel is held positively against the cam surface without recourse to any resilient return means, the two wheels combining their effects to take up the large radial forces to which the roller is subjected, and slack may be eliminated by axially adjusting the position of the second wheel relative to the surface of the counter-cam. As a result, the means for guiding each crimping roller as a function of the outline of the cam surface place no limit on the operating rate of the crimping head, since the effects of inertia and wear associated with the return springs have been eliminated. It may also be observed that since the two wheels are mounted on a common axis of rotation, guidance takes place independently of the orientation of the means for supporting the roller relative to the outline of the cam surface, the distance between it and the surface of the counter-cam remaining constant all around their outlines.

In a preferred embodiment, the second wheel is smaller in diameter than the first wheel and the cam surface extends transversely over a distance covering the combined thickness of the two superposed wheels, whereas the counter-cam surface extends transversely over a shorter distance, so as to face the second wheel only.

Advantageously, the cam surface and the counter-cam surface are constituted by the flanks of a groove formed in a plate around a suitable path, and of constant cross-section, the second wheel being adjacent to the bottom surface of the groove.

Preferably, the distance between the surface of the counter-cam and the work plane is constant, and slack is adjusted by displacing at least the second wheel along its axis relative to said plane.

Furthermore, it is possible to provide for the mutual separation between the two wheels along the direction of their common axis to be constant. That means in particular that when the adjustment is performed by axial displacement of the second wheel, both wheels are, in fact, displaced together. Such a disposition has no effect on guidance accuracy since the surface of the cam is a cylindrical surface made up of generating lines that are parallel to said axis.

In a particular embodiment in which the distance between the counter-cam surface and the work plane is constant, the two wheels are mounted coaxially on a common stub axle on which they are secured in the axial direction, and said stub axle is secured to the support piece carrying the roller by fixing means that enable its position to be adjusted relative to said plane along the direction of the axis common to the two wheels. In more detail, the stub axle may include a threaded end that screws into a tapped cavity formed in said support piece along the direction of the axis common to the two wheels, said cavity being opened by a radial slot such that it is formed between two branches of an elastically deformable fork, which branches can be tightened or loosened relative to each other so as to lock the stub axle to the support piece or so as to allow its position to be adjusted by progressive screwing or unscrewing.

BRIEF DESCRIPTION OF THE DRAWINGS

Other features and advantages of the invention appear from the following description of a non-limiting embodiment described with reference to the accompanying drawings, in which.

MORE DETAILED DESCRIPTION

Figure 1:
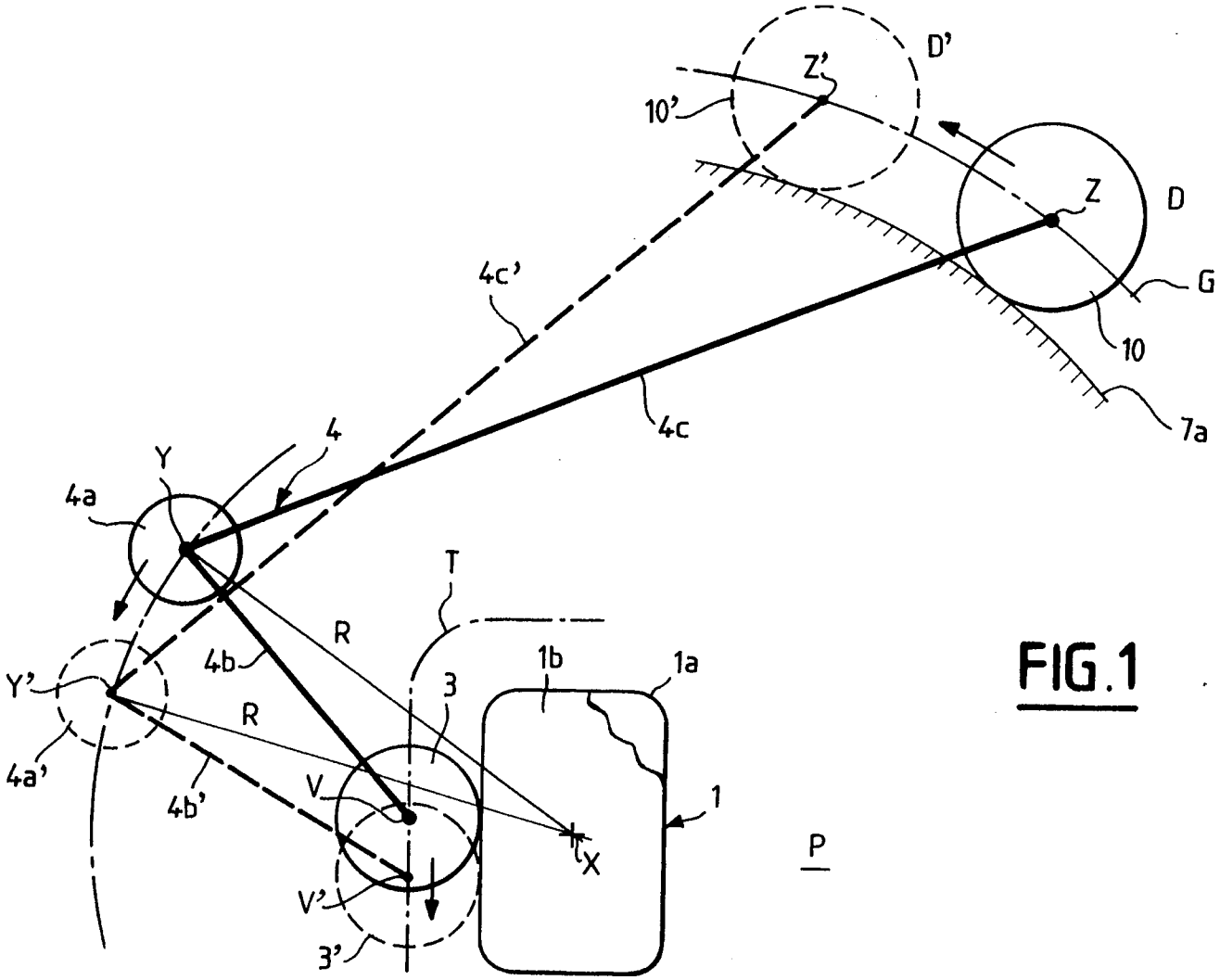
FIG. 1 shows the kinematics of a crimping head for shaped cans.
Figure 2:
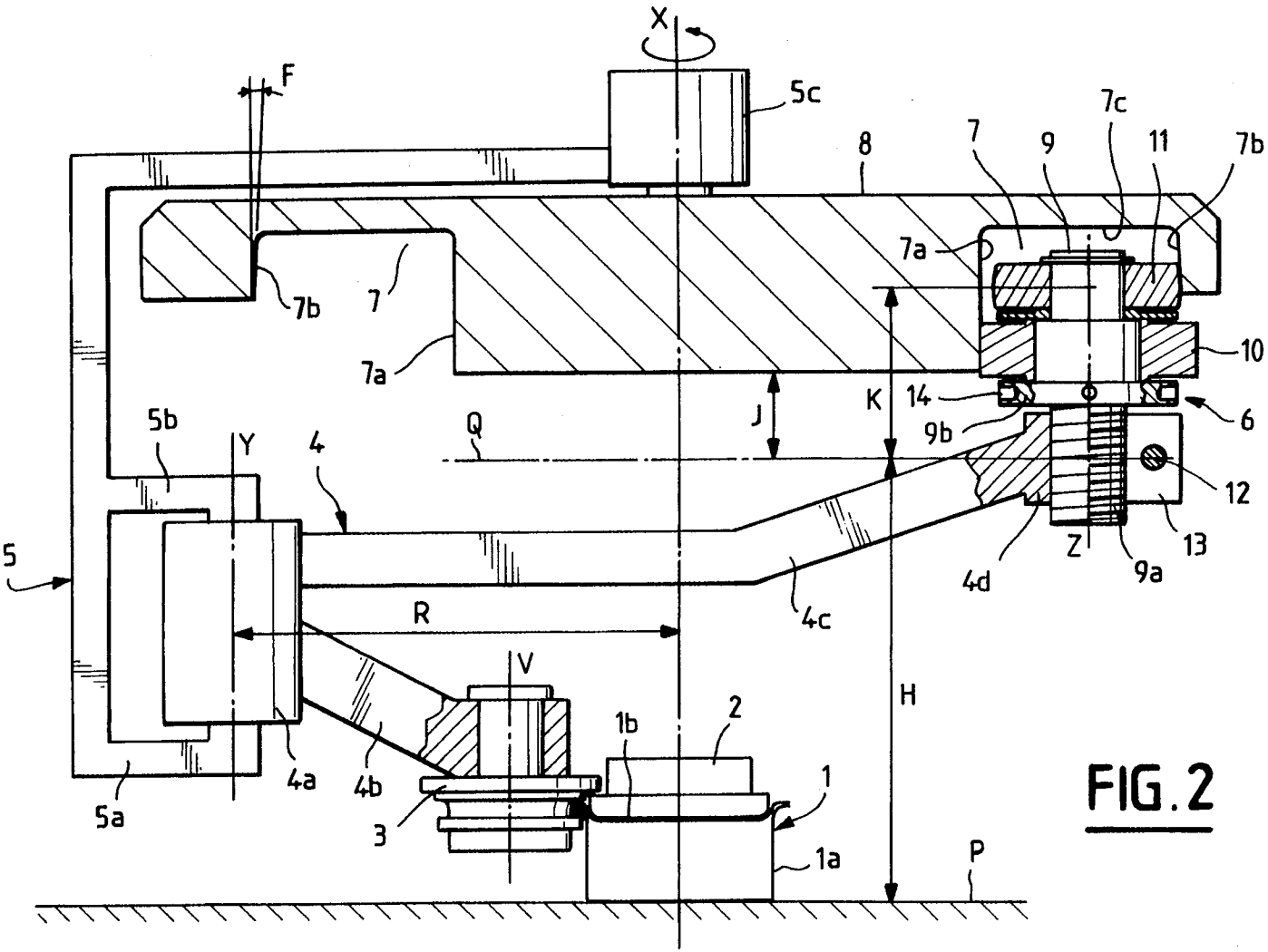
FIG. 2 is a diagrammatic axial section through the main elements associated with a roller in a crimping head of the invention.

FIG. 1 shows a food can 1 formed by a can body 1*a* and a lid 1*b*. The can has an outline that is not circular, and is referred to as a "shaped can". The can is placed on a horizontal work surface P at a location centered on a vertical axis X of a crimping head. The purpose of the crimping head is to crimp the lid 1*b* to the body 1*a* all around the edges thereof, while the lid is being pressed down onto the body by a stationary mandrel 2 (FIG. 2). This operation is performed by means of rotary crimping rollers, one of which (referenced 3) can be seen in FIG. 1. The roller 3 (like the other rollers) is guided so as to move around the can 1 while simultaneously rotating about its own vertical axis V, following a path T that corresponds accurately to the outline of the can. Each roller 3 is carried by a piece 4 comprising a hub 4*a* that pivots about a vertical axis Y and two arms 4*b* and 4*c* secured to the hub 4*a*. The roller is mounted at the end of one of said arms, given reference 4*b*, to which its axis of rotation V is connected. The pivot axis Y of the hub 4*a* is constrained to revolve about the axis X of the crimping head while remaining at a constant distance R from said axis. At the end of the other arm 4*c*, the support piece 4 has a wheel 10 whose axis of rotation Z is vertical and is supported by the arm. The wheel 10 is constrained to run against a cam surface 7*a* having an outline such as to act via the piece 4 to cause the roller 3 to follow accurately the outline of the can 1 to be crimped while the hub 4*a* of the piece 4 performs its rotary motion about the axis X. This result is shown in FIG. 1 where two positions D and D' of the piece 4 and its accessories are shown, with the accessories in position D' being designated by the same references as they are in position D, plus the prime symbol ['].

The lid 1*b* is thus crimped onto the body of the can 1*a* around the entire perimeter of the can.

It is important for this operation to be performed with great accuracy in the guidance of each crimping roller and for this to be done at high speed so as to enable a high crimping rate to be achieved.

These results are obtained by adopting special dispositions relating to the guide wheel 10, and which can be seen in FIG. 2.

FIG. 2 shows that the hub 4*a* is mounted between branches 5*a* and 5*b* of a piece 5 which also includes a rotary sleeve 5*c* centered on the axis X and capable of rotating about said axis while being prevented from moving along said axis. As a result, the hub 4*a* can revolve about the axis X, with its own axis Y remaining at a constant distance R therefrom, while simultaneously conserving constant spacing relative to the plane P, i.e. it describes a circle about the axis X, parallel to the plane P, and at a fixed determined distance therefrom. This means that the roller 3 is constrained to move while remaining at a constant height above the plane P. The same applies to the head 4*d* of the arm 4*c* which is situated at the end thereof which is remote from the hub 4*a* and which moves while remaining in a mean plane Q that is parallel to the plane P and is situated at a fixed determined distance H therefrom.

The head 4*d* of the arm 4*c* is fitted with a guide assembly 6 that includes the above-mentioned wheel 10 and which constrains the wheel to follow a cam surface 7*a* while the hub 4*a* is rotating about the axis X. The cam surface 7*a* is formed in a fixed plate 8 referred to as the "reproduction cam" and situated at a determined distance J above the plane Q. The surface of the cam is a cylindrical surface having vertical generating lines such that the axis Z of the wheel 10 follows a path G defined so that the axis V of the roller 3 consequently follows a path T that "reproduces" the outline of the can 1, account being taken of the radius of the roller.

The guide assembly 6 includes a stub axle 9 fixed to the head 4*d* and providing a generally cylindrical shape about the vertical axis Z. In addition to the wheel 10, this axle carries a second rotary wheel 11, with the two wheels being mounted one above the other so as to be capable of rotating about a common axis coinciding with above-specified axis Z. The lower wheel 10 is of slightly greater diameter than the upper wheel 11, and it has a cylindrical outside surface about the axis Z and it rolls along the cam surface 7*a*. The upper wheel 11 has an outside surface that forms a body of revolution but that is not cylindrical, since it bulges equatorially, with its section in a radial plane including the axis Z being constituted by an arc that is slightly convex towards the outside. This wheel co-operates with a counter-cam surface 7*b* formed in the plate 8 and facing the cam surface 7*a*. Like the surface 7*a*, the surface 7*b* follows a path that is parallel to the line G along which the axis Z is to be displaced. This surface is likewise a ruled surface, but this time instead of being parallel to the axes Z and X, its generating lines form a small angle of a few degrees relative thereto. Thus, the distance between the cam surface 7*a* and the counter-cam surface 7*b* which constitute the flanks of a groove 7 formed in the plate 8 decreases on going away from the head 4*d* of the piece 4. The wheel 11 is adjacent to the bottom surface 7*c* of the groove.

As can be seen in FIG. 2, the counter-cam surface 7*b* does not extend beyond the wheel 11 towards the head 4*d* so as to avoid interfering with the larger diameter wheel 10 which is interposed between the counter-cam surface and the head.

The stub axle 9 is fixed to the head 4*d* by a portion 9*a* that is threaded about the axis Z and that is screwed in a complementary tapped passage provided in the head 4*d*. By progressively screwing the stub axle 9 in or out relative to the head 4*d*, it is possible to make the stub axle move relative to the head along the Z axis direction. Such translation motion is transmitted in full to the wheels 10 and 11 which are axially secured relative to the stub axle 9. While the cylindrical wheel 10 then slides along a generator line of the cam surface 7*a* without causing any change in the distance between the axes Z and X, the bulging wheel 11 slides along a generating line of the counter-cam surface 7*b* that slopes at the angle F relative to the axis X. As a result, when the distance K between the wheel 11 and the fixed plane Q in which the head 4*d* moves is increased by adjusting the position of the piece 9 along the axis Z, any slack that used to exist between the surfaces 7*a*, 7*b* and the wheels 10, 11 of the guide assembly 6 will decrease until it becomes zero, with the two wheels 10 and 11 then bearing simultaneously against the respective surfaces 7*a*, 7*b* with which they co-operate, the wheel 10 being in linear contact with the surface 7*a* and the wheel 11 being in point contact with the surface 7*b*. Once this adjustment has been performed, the stub axle 9 is locked relative to the head 4*d* by clamping its threaded portion 9*a* in the tapped hole of the head 4*d*, which is open for this purpose by a slot 13. A screw is engaged in holes 12 formed through the two corresponding branches that are separated by said slot so as to resiliently clamp the branches against the threaded portion 9*a* of the stub axle 9, thereby locking it in position.

The adjustment of the stub axle 9 by measured rotation is facilitated by the fact that the stub axle is provided with a collar 9*b* that has cavities 14 in its periphery providing purchase for an appropriate rotary drive tool.

It will be observed that both before and after the axial position of the stub axle 9 has been adjusted, the distance between the axes Z and X remains unchanged, since that is determined solely by the wheel 10 whose outside surface is cylindrical and bears against the likewise cylindrical surface of the cam 7*a*, the generating lines of these two surfaces extending parallel to the above-mentioned axes. In other words, the greater or lesser extent to which the stub axle 9 and the wheels 10 and 11 are engaged in the groove 9 has no effect on the guidance parameters for the roller 3. Consequently, the positioning of the roller 3 via the support piece 4 remains independent of any slack take-up adjustments that may be performed on the guide assembly 6, thereby automatically retaining the guidance accuracy of the roller 3 (of the order of 1/100th of mm for a first pass roller which performs an initial crimping together operation on the peripheries of the parts prior to them being crushed against each other by a second pass roller).

I claim:

1. A crimping head for sealing food cans by crimping a lid on a can body, the lid having an edge and the can body having an outline and having an edge, the head comprising at least one crimping roller mounted on a moving support piece that causes said crimping roller to move in a plane parallel to a work plane on which the can body to be crimped stands, so as to follow a path such that said crimping roller follows exactly the outline of the can body while remaining pressed thereagainst so as to crimp the edge of the lid onto the edge of the can body, a guide connected to said support piece to constrain said roller to follow said path, said guide comprising a first rotary wheel having an axis perpendicular to said work plane, and said guide further comprising a cylindrical cam surface having generator lines perpendicular to said work plane, said generator lines following an appropriate outline that extends parallel to said work plane, said wheel running against said cam surface, a holding assembly connected to said wheel to hold said wheel in contact with said cam surface, said holding assembly comprising a second rotary wheel juxtaposed with said first wheel, such that both rotary wheels rotate about said axis, said second wheel having a bulging peripheral surface having a section in a radial plane, which section is a curved line convex toward the outside, and said holding assembly further comprising a counter-cam surface situated facing said cam surface, said counter-cam surface comprising a bearing and running surface for said second wheel, said counter-cam surface extending parallel to said cam surface while being inclined at a small angle relative to the direction of said axis of said two wheels, the relative position along the direction of said axis between said second wheel and said counter-cam surface being adjustable so as to make it possible to adjust the slack between the assembly of said two wheels and said facing cam and counter-cam surfaces between which said assembly of said two wheels is interposed.

2. A crimping head according to claim 1, wherein said second wheel is smaller in diameter than said first wheel and said cam surface extends transversely over a distance covering the combined thickness of said two superposed wheels, whereas said counter-cam surface extends transversely over a shorter distance, so as to face said second wheel only.

3. A crimping head according to claim 1, further comprising a plate having therein a groove, said groove having a bottom side and having flanks defining said cam surface and said counter-cam surface, said flanks of said groove being formed in said plate around a suitable path, and of constant cross-section, said second wheel being adjacent to said bottom surface of said groove.

4. A crimping head according to claim 1, wherein the distance between said surface of said counter-cam and said work plane is constant, and the slack is adjusted by displacing at least said second wheel along said axis relative to said work plane.

5. A crimping head according to claim 1, wherein the mutual separation between said two wheels along the direction of said axis is constant.

6. A crimping head according to claim 5, wherein the distance between said counter-cam surface and said work plane is constant, and said two wheels are mounted coaxially on a common stub axle on which said wheels are secured in the axial direction, said stub axle being secured to said support piece carrying said crimping roller by fixing means that enable said crimping roller's position to be adjusted relative to said plane along the direction of said axis.

7. A crimping head according to claim 6, wherein said stub axle includes a threaded end that screws into a tapped cavity formed in said support piece along the direction of said axis, said cavity being opened by a radial slot such that said cavity is formed between two branches of an elastically deformable fork, which branches can be tightened or loosened relative to each other so as to lock said stub axle to the support piece or so as to allow said stub axle's position to be adjusted by progressive screwing or unscrewing.

* * * * *

UNITED STATES PATENT AND TRADEMARK OFFICE

CERTIFICATE OF CORRECTION

PATENT NO. : 5,390,471

DATED : February 21, 1995

INVENTOR(S) : Jean-Charles Marchadour

It is certified that error appears in the above-identified patent and that said Letters Patent is hereby corrected as shown below:

Column 1, line 7, the word "Scaling" should read --sealing--.

Signed and Sealed this

Second Day of May, 1995

Bruce Lehman

*Attest:*

BRUCE LEHMAN

*Attesting Officer*

*Commissioner of Patents and Trademarks*